US008128454B2

(12) United States Patent
Rosenblum

(10) Patent No.: US 8,128,454 B2
(45) Date of Patent: Mar. 6, 2012

(54) TOY FOR ROTATING AND LAUNCHING AN OBJECT

(75) Inventor: Brian Rosenblum, Sherman Oaks, CA (US)

(73) Assignee: JAKKS Pacific, Inc., Malibu, CA (US)

( * ) Notice: Subject to any disclaimer, the term of this patent is extended or adjusted under 35 U.S.C. 154(b) by 804 days.

(21) Appl. No.: 11/975,721

(22) Filed: Oct. 19, 2007

(65) Prior Publication Data

US 2008/0176483 A1 Jul. 24, 2008

Related U.S. Application Data

(63) Continuation-in-part of application No. 11/183,118, filed on Jul. 14, 2005, now Pat. No. 7,500,898.

(60) Provisional application No. 60/853,527, filed on Oct. 20, 2006.

(51) Int. Cl.
*A63H 29/00* (2006.01)

(52) U.S. Cl. ..... 446/429; 446/236; 446/38; 463/7; 463/58; 463/66

(58) Field of Classification Search ..... 446/236, 446/429, 37–39, 430; 463/7, 58, 66
See application file for complete search history.

(56) References Cited

U.S. PATENT DOCUMENTS

| | | | | |
|---|---|---|---|---|
| 2,243,780 | A | 5/1941 | Thigpen | |
| 3,570,467 | A * | 3/1971 | Belokin, Jr. | 446/38 |
| 3,701,216 | A * | 10/1972 | Smith et al. | 446/429 |
| 3,735,526 | A | 5/1973 | Ensmann et al. | |
| 3,798,832 | A | 3/1974 | Terzian | |
| 3,812,933 | A * | 5/1974 | Darda | 446/462 |
| 3,895,458 | A | 7/1975 | Lemelson | |
| 4,541,813 | A | 9/1985 | Ikeda | |
| 4,756,703 | A | 7/1988 | Kennedy et al. | |
| 5,525,086 | A * | 6/1996 | Gentile et al. | 446/37 |
| 6,364,734 | B1 | 4/2002 | Ng | |
| 2006/0046609 | A1 | 3/2006 | Laurienzo et al. | |
| 2006/0046610 | A1 | 3/2006 | Laurienzo et al. | |
| 2006/0099880 | A1 | 5/2006 | Laurienzo et al. | |

FOREIGN PATENT DOCUMENTS

GB 374362 A 6/1932

OTHER PUBLICATIONS

International Preliminary Report on Patentability from PCT/US2007/022448.

* cited by examiner

*Primary Examiner* — Gene Kim
*Assistant Examiner* — Urszula M Cegielnik
(74) *Attorney, Agent, or Firm* — Tope-McKay & Associates; Marcus Risso

(57) ABSTRACT

A toy with a launcher to rotate and launch an object is described. Attached within housing, the launcher comprises a driving element to form a drive connection with a receiving element on the object. The launcher is connected with a launcher rotating system, which imparts a rotary movement to the launcher. An energy storing system is mounted inside the housing and drivingly connected with the launcher rotating system. The energy storing system is configured to store potential energy, where upon release, the potential energy is converted to kinetic energy to actuate the launcher rotating system. Thus, user may use the toy to rotate and launch an object from the toy.

14 Claims, 10 Drawing Sheets

TOY FOR ROTATING AND LAUNCHING AN OBJECT

PRIORITY CLAIM

The present application is a Continuation-in-Part patent application, claiming the benefit of priority of U.S. patent application Ser. No. 11/183,118, filed Jul. 14, 2005 now U.S. Pat. No. 7,500,898, entitled "Toy for Rotating and Launching an Object," and also claiming the benefit of priority of U.S. Provisional Application No. 60/853,527, filed on Oct. 20, 2006, titled, "Multi-aspect toy."

BACKGROUND OF THE INVENTION (1) Technical Field

The present invention relates to a toy for rotating and launching an object and, more particularly, to a ripcord-less launching mechanism for rotating and launching an object that provides for the safety of a user.

(2) Description of Related Art

Toy launchers are well-known in the art. Toys that accelerate and launch gliders, helicopters, cars, and parachutes are well-documented. One method of launching a toy is through a rotary motion, often utilizing a gear system to turn a shaft that rotates the toy.

An example of one launcher is disclosed in U.S. Pat. No. 3,701,216, issued to Smith, III et al. (hereinafter "the Smith patent"). The launcher taught in the Smith patent uses a gear rack to drive a gear train and rotate a wheel that is mounted on a shaft. As the gear rack is withdrawn from the toy, a wheel ejector coupled to the gear rack pivots to force the wheel off of the shaft and launch the wheel.

The devices according to the Smith patent have several shortcomings, the first of which is the need for a separate mechanical ejector to release the wheel from the toy. In addition to increasing the cost to manufacture the toy, the wheel ejector device adds to the complexity of design of the toy.

Another shortcoming of the devices made according to the Smith patent is the possibility of causing injury to the user if the wheel is launched in the direction of the user. If the toy is particularly oriented, the wheel will rotate and launch toward the user, risking injury.

Therefore, a need exists for a toy launcher with a cost-effective launching mechanism built into the design of the toy and capable of preventing the toy from being launched in the direction of the user.

SUMMARY OF THE INVENTION

The present invention overcomes the aforementioned limitations and fills the aforementioned needs by providing a toy for rotating and launching an object.

The toy comprises a housing with a launcher extending from the housing. The launcher is configured to impart a rotary motion to an object. The launcher comprises a driving element configured to engage a receiving element. The receiving element is attached with an object to form a drive connection, such that when the driving element engages the receiving element, the object is rotationally accelerated in one direction. A launcher rotating system is mounted inside the housing and connected with the launcher. The launcher rotating system is configured to impart a rotary motion to the launcher. An energy storing system is mounted inside the housing and drivingly connected with the launcher rotating system. The energy storing system is configured to store kinetic energy where upon release, the kinetic energy is converted to actuate the launcher rotating system, whereby a user may use the toy to rotate and launch an object from the toy.

In another aspect, the launcher rotating system includes a launcher attachment mechanism that is formed to enable the object to be detachably attached with the toy. The launcher attachment mechanism is formed to engage with a corresponding object attachment mechanism such that upon actuation of the launcher attachment mechanism, the object attachment mechanism is released from the toy.

In yet another aspect, the present invention further comprises a key for winding energy storing system to store kinetic energy therein. A trigger is also included for actuating the energy storing system and the launcher attachment mechanism. Upon actuation, the energy storing in the energy storing system is released to cause the launcher rotating system to rotate the launcher and the launcher attachment mechanism releases the object attachment mechanism, thereby launching the object.

The driving element comprises two substantially helical tabs extending in a parallel configuration from the shaft about an axis, the axis running substantially parallel to and substantially centered in the shaft. The receiving element of the object is similarly configured with two substantially helical tabs extending outward in parallel configuration about an axis. The axis runs perpendicular to the rotational motion of the object. The two substantially helical tabs of each of the driving element and receiving element has an edge that runs parallel to the axis of the respective driving element and receiving element, such that the edge of the driving element rests flush against the edge of the receiving element, forming a drive connection which allows the rotation of the driving element to rotate the receiving element.

In another aspect, the edge of the driving element and the edge of the receiving element are formed as matching and interlocking shapes, such that when the edge of the driving element is matched with the edge of the receiving element, an interlocking drive connection is formed.

In yet another aspect, the edge of the driving element and the edge of the receiving element are formed as a hook shapes, such that when the edge of the driving element is matched up with the edge of the receiving element, an interlocking drive connection is formed.

Additionally, the launcher rotating system comprises a series of interconnected gears and axles, which are capable of rotating the launcher. In another aspect, the radius of the gears is selected to provide a desired input-to-output gear ratio.

Finally, the present invention also comprises a method for forming and using the toy described herein. In one aspect, the method comprises acts of a housing; forming a launcher extending from the housing, the launcher configured to impart a rotary motion to an object, wherein the launcher comprises a driving element configured to engage a receiving element, the receiving element attached with an object to form a drive connection, such that when the driving element engages the receiving element, the object is rotationally accelerated in one direction; mounting a launcher rotating system inside the housing and connecting the launcher rotating system with the launcher, the launcher rotating system configured to impart a rotary motion to the launcher; and mounting an energy storing system inside the housing and drivingly connecting the energy storing system with the launcher rotating system, the energy storing system configured to store energy where upon release, the potential energy is converted to actuate the launcher rotating system, whereby a user may use the toy to rotate and launch an object from the toy.

In another aspect, the method comprises the act of forming a launcher attachment mechanism to enable the object to be detachably attached with the toy, wherein the launcher attachment mechanism is formed to engage with a corresponding object attachment mechanism such that upon actuation of the launcher attachment mechanism, the object attachment mechanism is released from the toy.

In another aspect, the method comprises the act of forming a key for winding the energy storing system to store kinetic energy therein.

In another aspect, the method comprises the act of forming a trigger for actuating the energy storing system and the launcher attachment mechanism, where upon actuation, the energy storing in the energy storing system is released to cause the launcher rotating system to rotate the launcher and the launcher attachment mechanism releases the object attachment mechanism, thereby launching the object.

In another aspect, the method comprises the act of forming the driving element of two substantially helical tabs extending in a parallel configuration from a shaft about an axis, the axis running substantially parallel to and substantially centered in the shaft, and wherein the receiving element of the object is similarly configured with two substantially helical tabs extending outward in parallel configuration about an axis, the axis running perpendicular to the rotational motion of the object, and wherein the two substantially helical tabs of each of the driving element and receiving element has an edge that runs parallel to the axis of the respective driving element and receiving element, such that the edge of the driving element rests flush against the edge of the receiving element, forming a drive connection which allows the rotation of the driving element to rotate the receiving element.

In another aspect, the method comprises the act of forming the edge of the driving element and the edge of the receiving element as matching and interlocking shapes, such that when the edge of the driving element is matched with the edge of the receiving element, an interlocking drive connection is formed.

In another aspect, the method comprises the act of forming the edge of the driving element and the edge of the receiving element as hook shapes, such that when the edge of the driving element is matched up with the edge of the receiving element, an interlocking drive connection is formed.

In another aspect, the method comprises the act of forming a launcher rotating system comprising a series of interconnected gears and axles, the gears and axles capable of rotating the launcher.

In another aspect, the method comprises the act of selecting the radius of the gears to provide a desired input-to-output gear ratio.

BRIEF DESCRIPTION OF THE DRAWINGS

The objects, features and advantages of the present invention will be apparent from the following detailed descriptions of the disclosed aspects of the invention in conjunction with reference to the following drawings, where.

DETAILED DESCRIPTION

Figure 1:
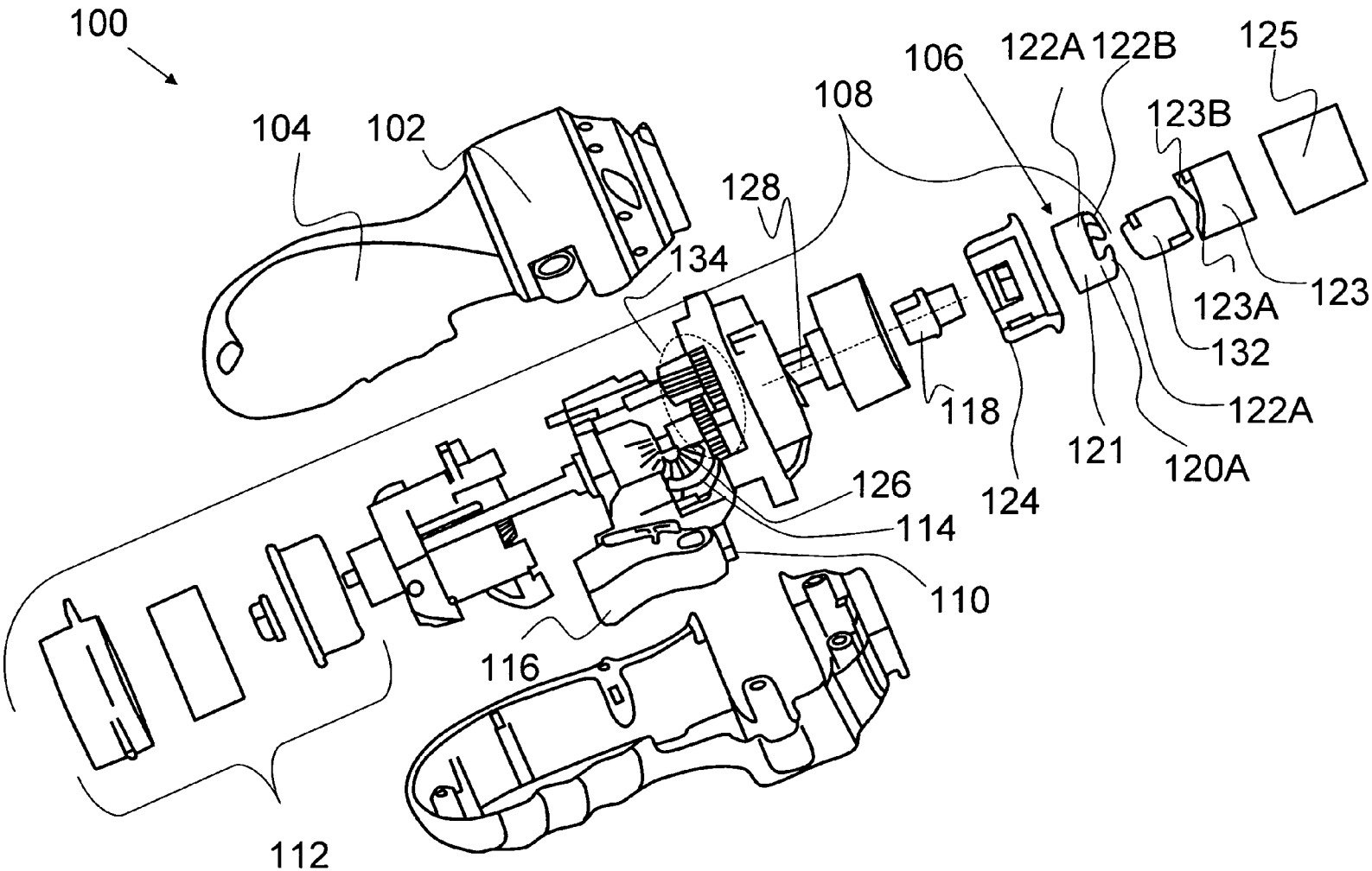
FIG. 1 is an illustration of a toy according to the present invention, depicting an exploded view of the toy.

The present invention relates to a toy for rotating and launching an object. More specifically, the present invention relates to a ripcord-less launching mechanism for rotating and launching an object that provides for the safety of a user. The following description, taken in conjunction with the referenced drawings, is presented to enable one of ordinary skill in the art to make and use the invention and to incorporate it in the context of particular applications. Various modifications, as well as a variety of uses in different applications, will be readily apparent to those skilled in the art, and the general principles, defined herein, may be applied to a wide range of aspects. Thus, the present invention is not intended to be limited to the aspects presented, but is to be accorded the widest scope consistent with the principles and novel features disclosed herein. Furthermore, it should be noted that unless explicitly stated otherwise, the figures included herein are illustrated diagrammatically and without any specific scale, as they are provided as qualitative illustrations of the concept of the present invention.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents that are filed concurrently with this specification and are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Before describing the invention in detail, an introduction is provided to provide the reader with a general understanding of the present invention. Next, a description of various aspects of the present invention is provided to give an understanding of the specific details.

(1) Introduction

The present invention relates to a toy for rotating and launching an object. More specifically, the present invention relates to a ripcord-less launcher for launching the object.

The launcher is formed to hold, rotate and release an object, such as a toy wheel. A launcher with a pair of helical tabs extends from a shaft on the toy and interlocks with matching tabs on an object to mount the object on the shaft. In one aspect, a user may turn a key to wind up a gear train in the toy. Alternatively, the user may rotate the object (after the object is attached with the launcher) backwards to wind up the gear train. Upon activating the release button, the shaft is rotated which, in turn, rotates the object mounted to the launcher. A release mechanism is actuated by the release button to release the rotating object, thereby launching the object away from the launcher. The launcher is configured to release the object in only one direction.

(2.1) Basic Operation

In one aspect, as illustrated in FIG. 1, the toy 100 comprises a housing 102, a handle 104, a launcher 106, and a launcher rotating system 108. For clarity, FIG. 1 is an exploded-view illustration of the toy 100 to illustrate internal components of the toy 100. The launcher rotating system 108 is located inside the housing 102 and is drivingly connected with a key 110. The key 110 is connected with an energy storing system 112 through a gear train 114. The energy storing system 112 is any suitable system for storing kinetic energy as potential energy, a non-limiting example of which includes a coil spring. When the key 110 is turned, the gear train 114 winds up the energy storing system 112 to store potential energy therein. Alternatively, when an object is attached with the launcher rotating system 108, the object may be turned backward to wind up the energy storing system 112.

Using the trigger 116, the energy can be released from the system and the object launched from the launcher 106. When the energy is released from the energy storing system 112, the launcher rotating system 108 translates the potential energy into movement of the gear train 114 in a rotary motion. The launcher rotating system 108 is then drivingly connected with the launcher 106. When an object such as a wheel is connected with the launcher 106, the launcher 106 rotationally accelerates the wheel until the wheel is released from the launcher 106 and propelled forward.

(2.2) Launcher Mechanism

Figure 2A:
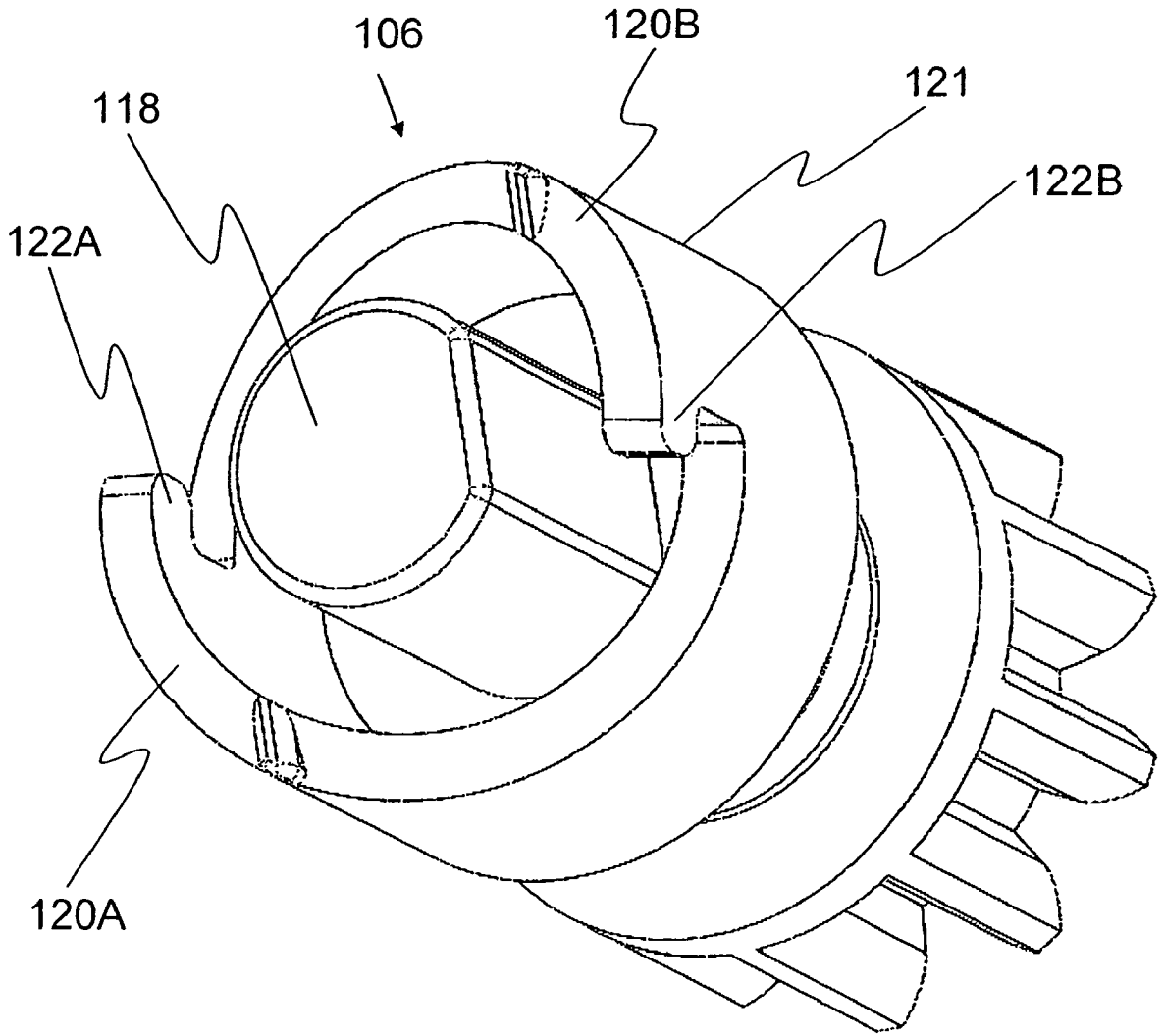
FIG. 2A is an illustration of a toy according to the present invention, depicting the structure of the driving element of the launcher.

The launcher 106 functions to retain an object, rotate the object, and launch the object. In one aspect, the launcher 106 is mounted to an output axle 118 which is drivingly connected with the gear train 114. FIGS. 1 and 2A illustrate the specific design of one aspect of the launcher 106, including a driving element 121. The driving element 121 comprises two identical helical tabs 120A and 120B, which extend outward in a parallel configuration from the output axle 118 about an axis 128, such that the axis 128 runs parallel to and centered in the output axle 118. The edges 122A and 122B of each of the helical tabs 120A and 120B are formed into hook shapes.

Figure 2B:
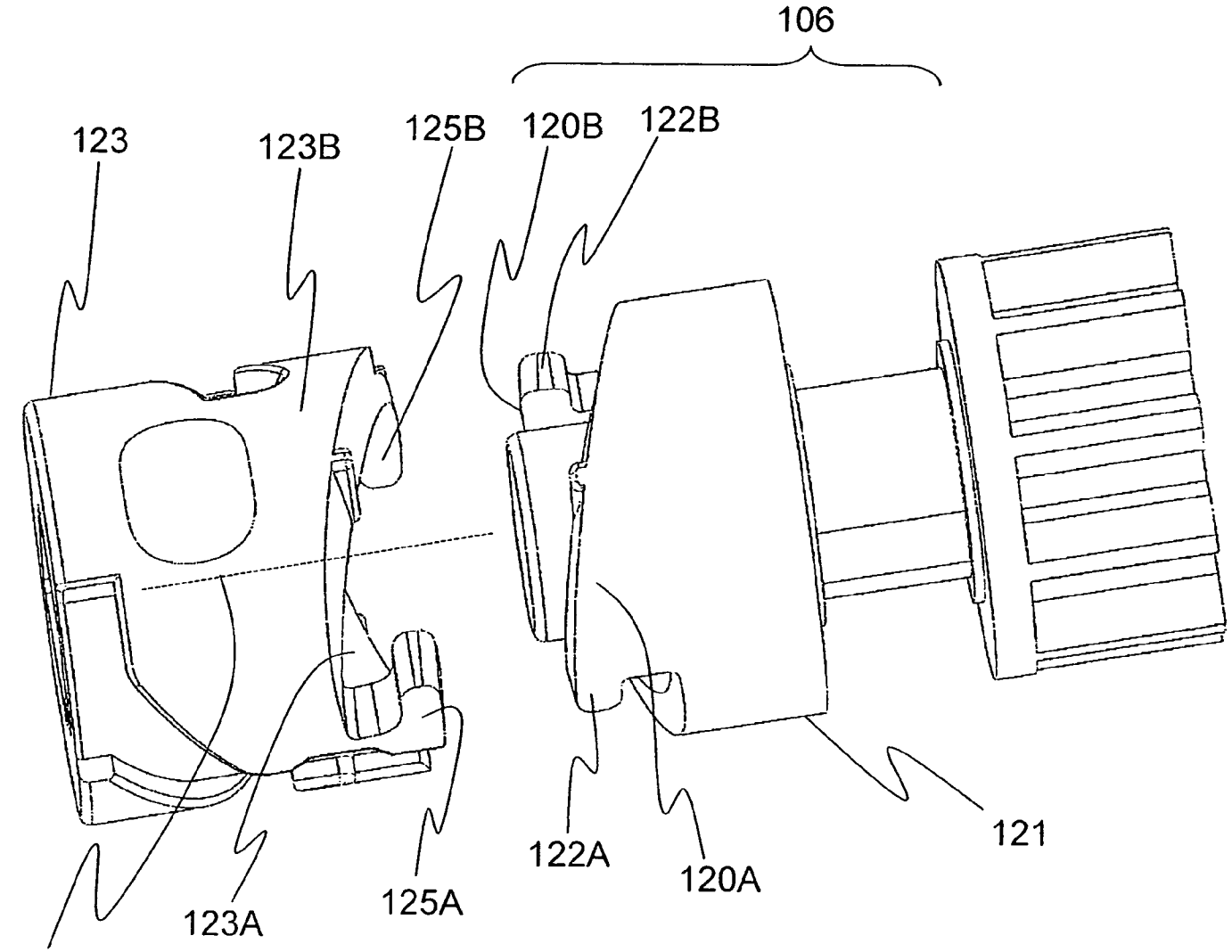
FIG. 2B is an illustration of a toy according to the present invention, depicting the relationship of the structure of the driving element with a receiving element.
Figure 2C:
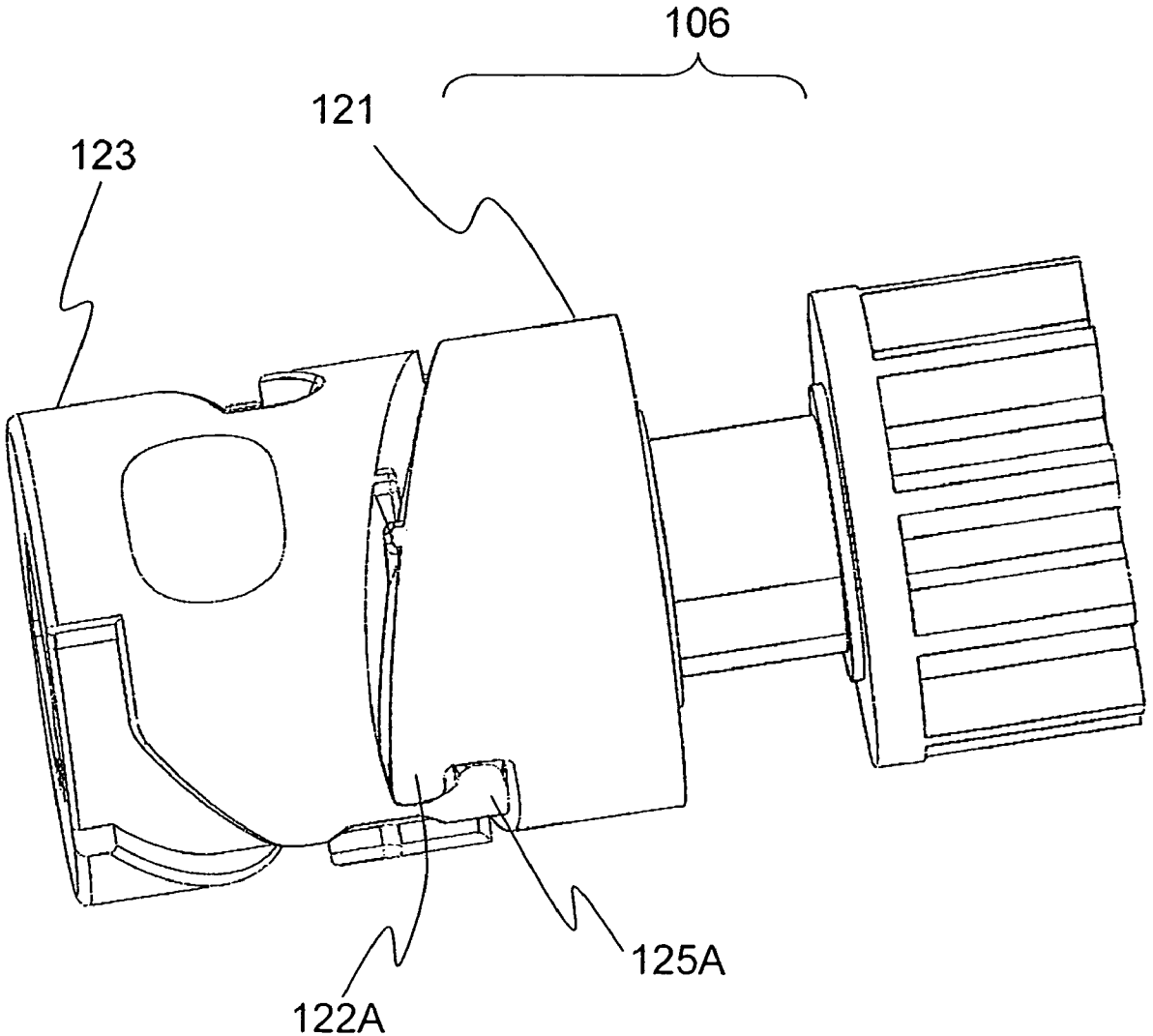
FIG. 2C is an illustration of a toy according to the present invention, depicting an interlocking drive connection between the driving element and the receiving element.

FIG. 2B illustrates how the helical tabs 120A and 120B of the driving element 121 are configured to interlock, as matching and interlocking shapes, with similar helical tabs 123A and 123B about an axis 132 on a receiving element 123 that is connected with an object to be rotated (not illustrated). In particular, the hook-shaped edges 122A and 122B of the driving element 121 are configured to match up with the hook-shaped edges 125A and 125B of the helical tabs 123A and 123B of the receiving element 123, forming an interlocking drive connection. The interlocking drive connection, as illustrated in FIG. 2C, allows a user to rotate the toy in any orientation and still maintain the interlocking drive connection between the driving element 121 and the receiving element 123. Due to the interlocking drive connection between the corresponding hook-shaped edges (e.g., 122A and 125A), the driving element 121 engages the receiving element 123 to rotationally accelerate an object (not illustrated) in one direction.

Referring again to FIG. 1, the launcher rotating system 108 includes a launcher attachment mechanism 124. The launcher attachment mechanism 124 enables the object to be detachably attached with the toy 100. In operation, the object also includes an object attachment mechanism 125 and the referenced receiving element 123. The receiving element 123 is aligned with the driving element 121, while the object attachment mechanism 125 is affixed with the launcher attachment mechanism 124.

Once an interlocking drive connection is made between the driving element 121 and the receiving element 123, the user can turn the key 110 to build the amount of potential energy stored in the energy storing system 112. When the user pulls the trigger 116, the launching rotating system 108 translates the potential energy into a rotary motion to rotate the driving element 121 and thereby rotate the object connected with the receiving element 123. When the launcher rotating system 108 ceases to accelerate the launcher 106 and the driving element 121, the receiving element 123 disengages from the driving element 121 and releases the object from the interlocking drive connection. This is accomplished because once the launcher rotating system 108 ceases to rotate the driving element 121, the rate of rotation of the driving element 121 decreases immediately. However, due to the object's inertia, the rotational velocity of the receiving element 123 decreases more slowly, and the object and receiving element 123 rotate away from the driving element 121 and disengage from the interlocking drive connection. Thus, once the object is affixed with the launcher 106 (and the energy storing system 112 is wound up), a user may use the trigger 116 to release the object from the interlocking drive connection, which forces the object attachment mechanism 125 to be released from the launcher attachment mechanism 124, thereby launching the object.

Figure 2D:
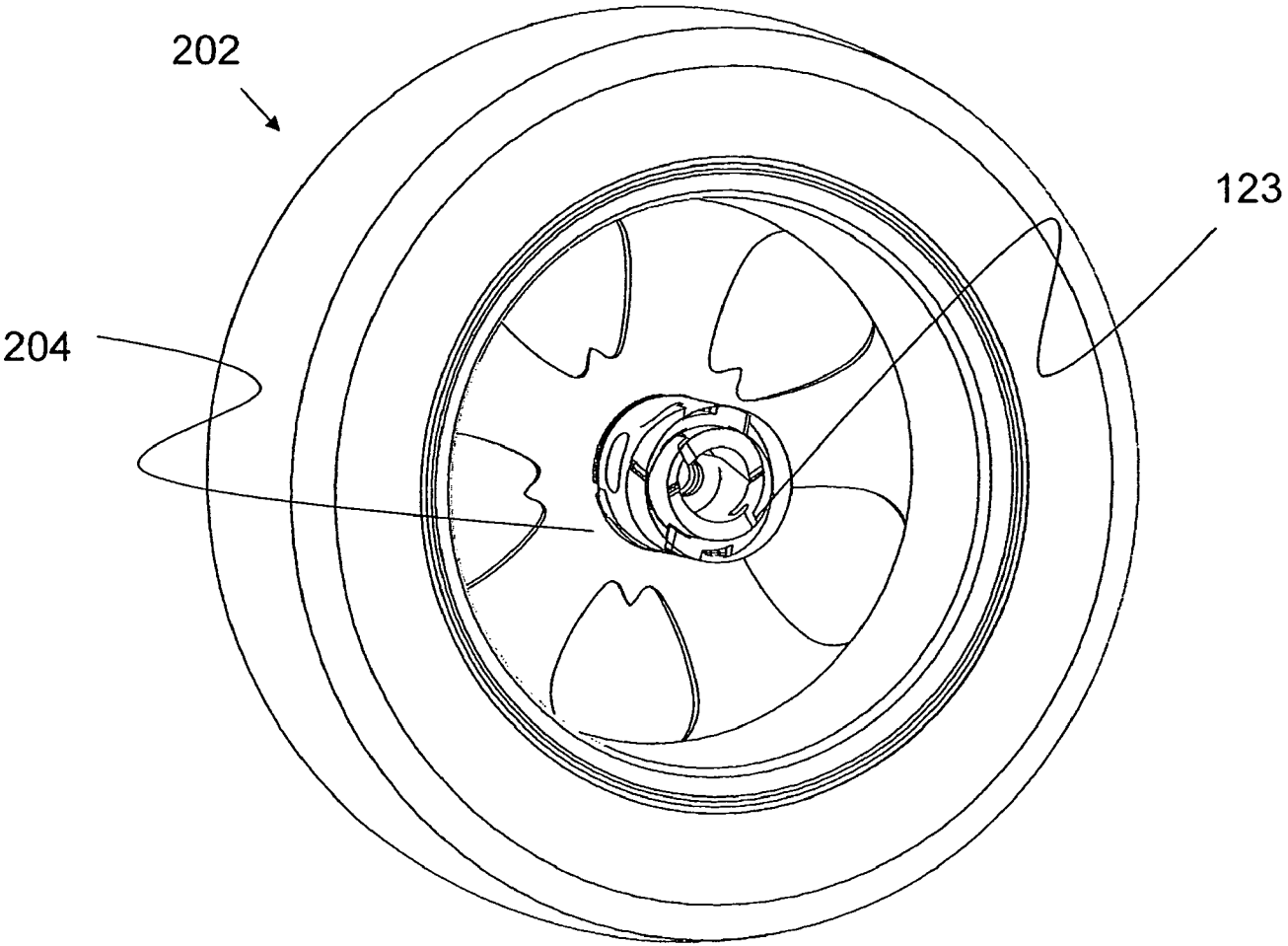
FIG. 2D is an illustration of a toy according to the present invention, depicting a wheel configured with the receiving element.
Figure 3:
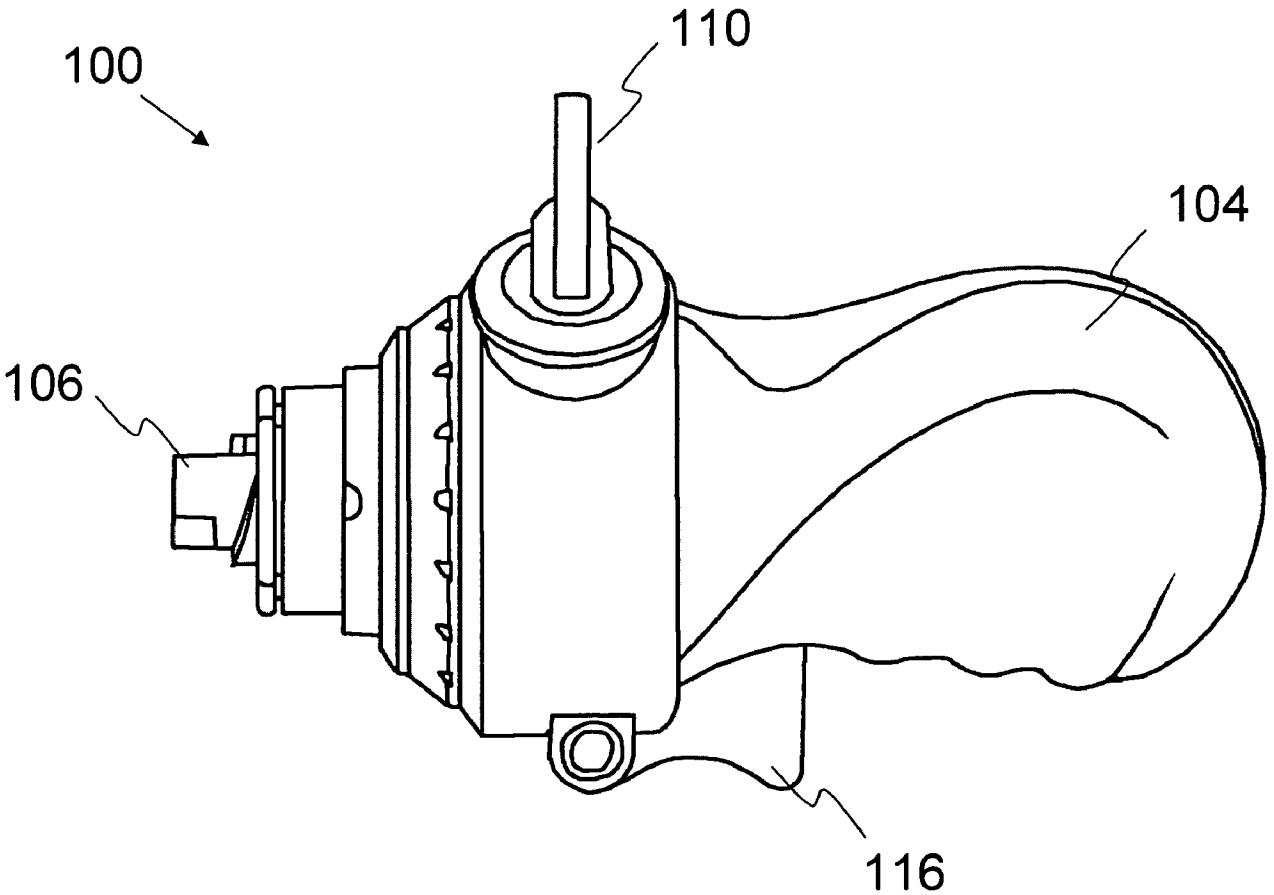
FIG. 3 is a side, perspective-view illustration of a toy according to the present invention.
Figure 4:
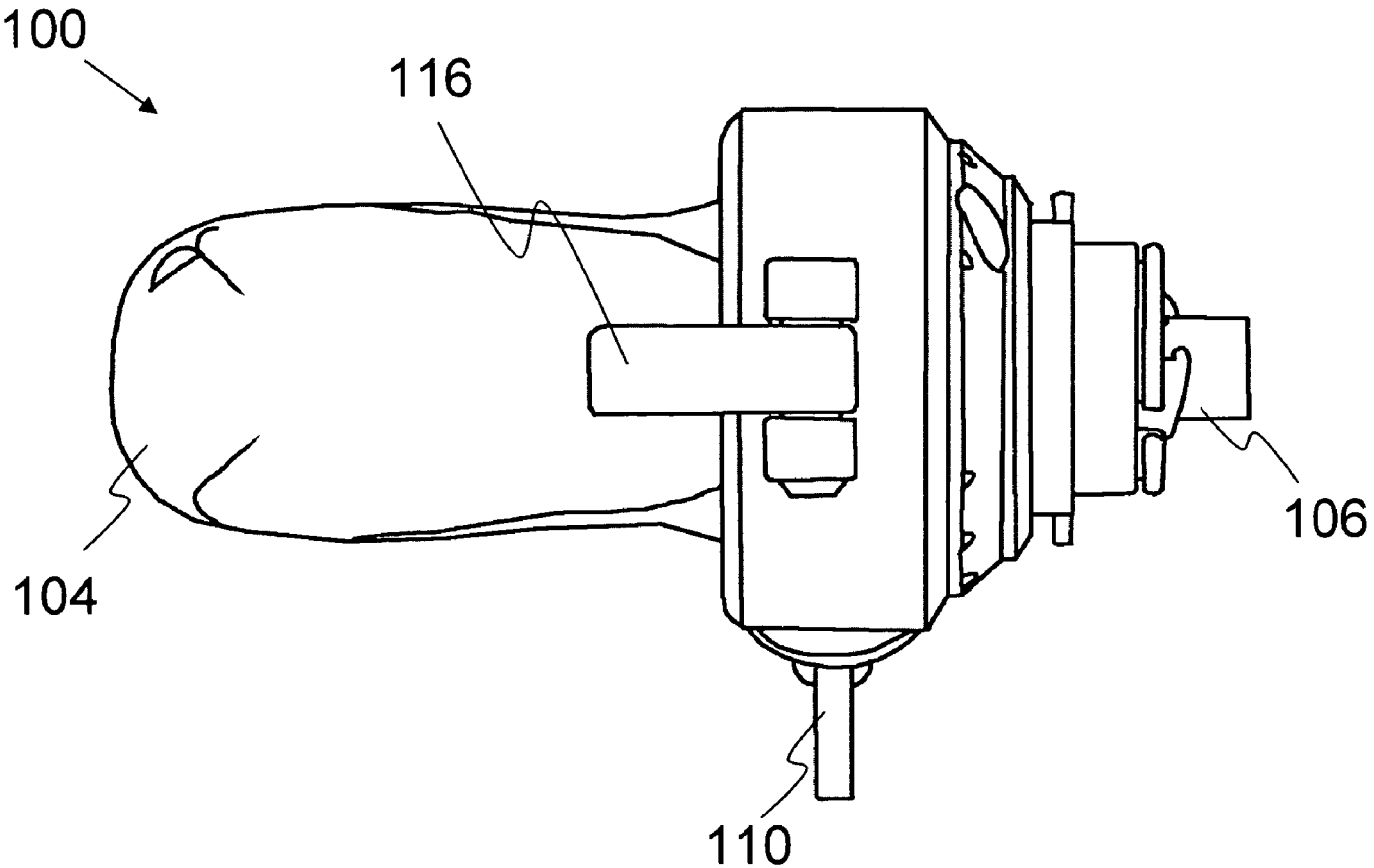
FIG. 4 is an orthogonal, side-view illustration of a toy according to the present invention.
Figure 5:
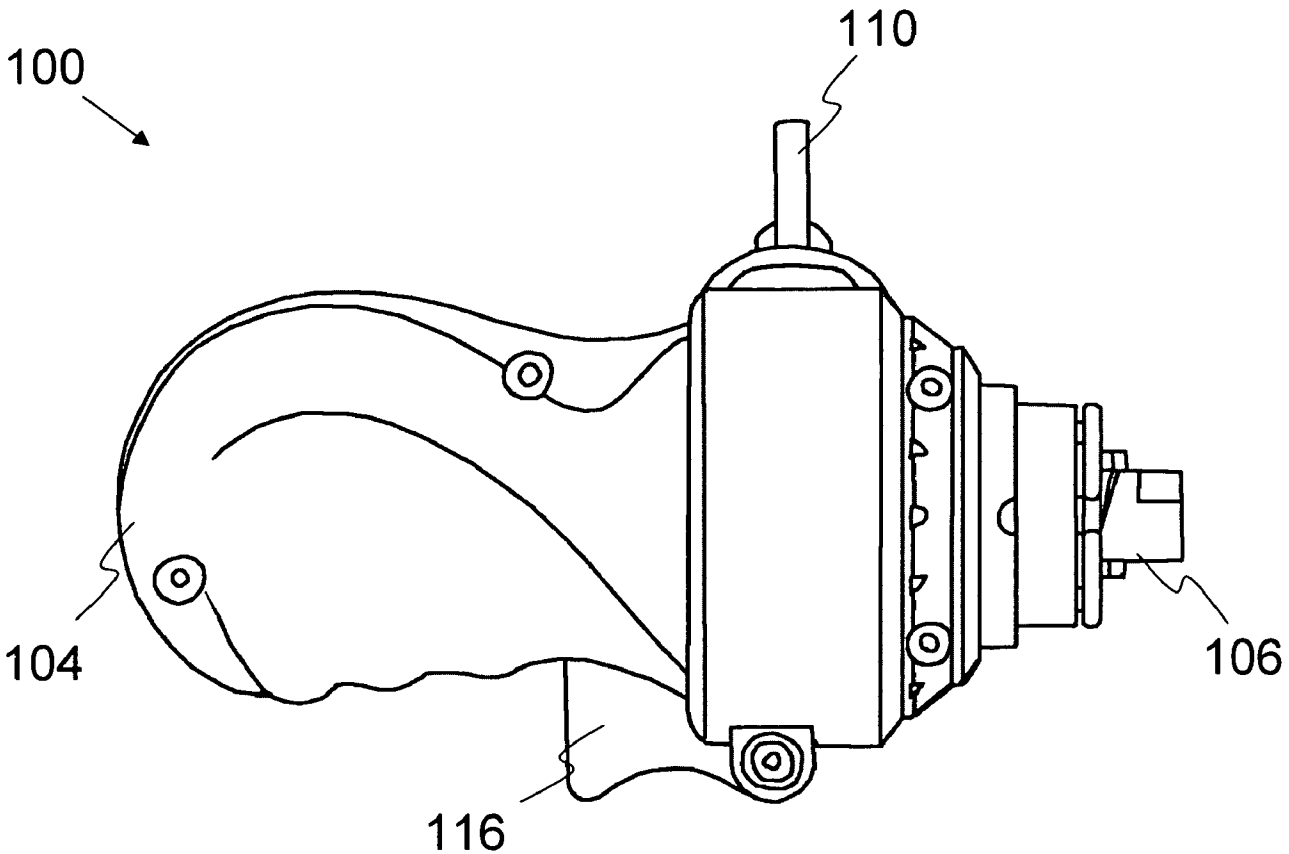
FIG. 5 is an orthogonal, side-view illustration of a toy according to the present invention.
Figure 6:
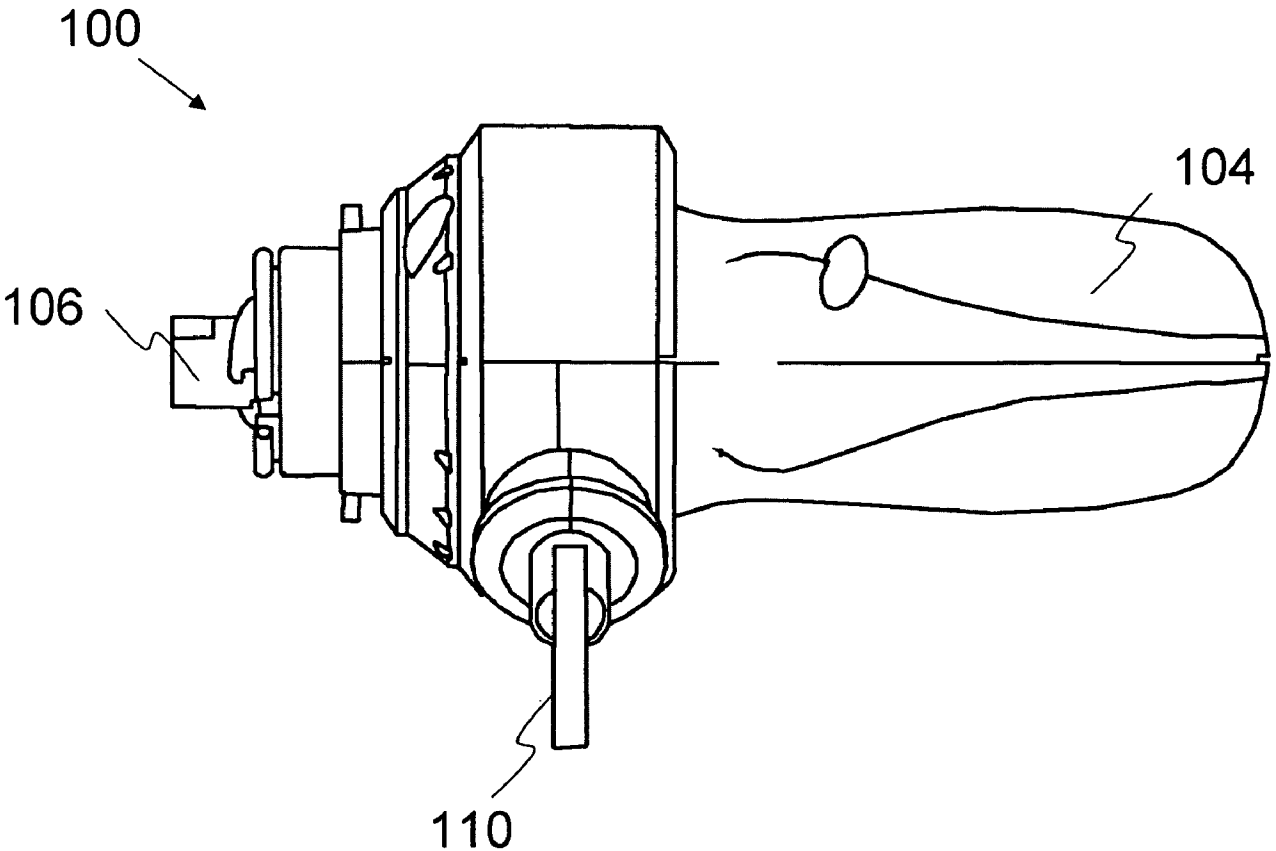
FIG. 6 is a perspective, side-view illustration of a toy according to the present invention.
Figure 7:
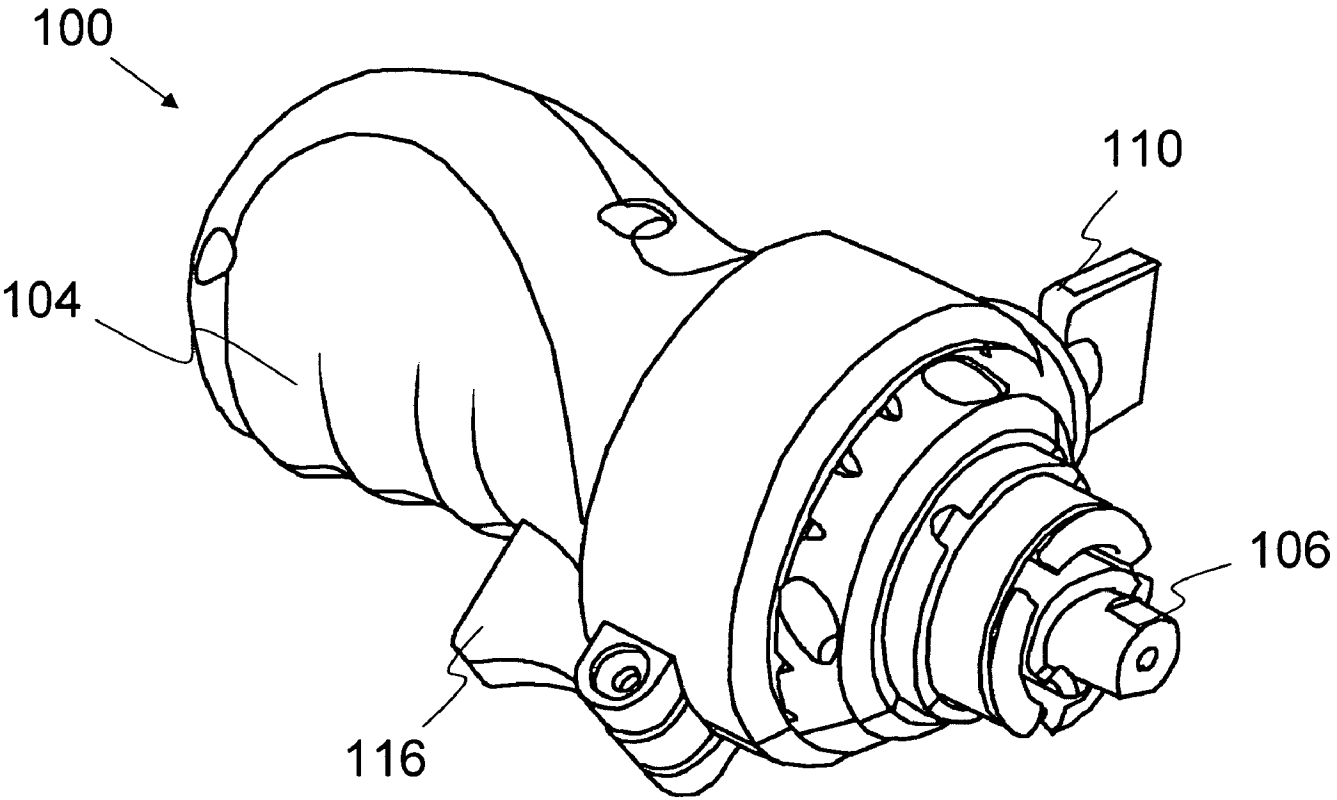
FIG. 7 is a perspective, side and frontal view of a toy according to the present invention.

It should be noted that the object is any suitable object that can be launched from the toy, non-limiting examples of which include balls and wheels. In the aspect where the object is a wheel 202, the receiving element 123 is rotationally connected with the hub 204 of the wheel 202, as illustrated in FIG. 2D.

(2.3) Launcher Rotating System

Referring again to FIG. 1, the launcher rotating system 108 comprises a series of gears and axles to impart a rotary motion to the launcher 106. In one aspect, the launcher rotating system 108 comprises a key 110 with an input gear 126. The input gear 126 is a single gear or, in another aspect, includes a set of gears and pinions to connect the key 110 with the energy storing system. The launcher rotating system 108 further comprises a set of output gears 136 that are drivingly connected with and between the energy storing system 112 and the output axle 118. The output gears 136 translate the rotational forces from the energy storing system 112 to the output axle 118. Thus, the launcher rotating system 108 is drivingly connected with the output axle 118, where the output axle 118 is connected with the launcher 106 to launch the object.

One skilled in the art will appreciate that by changing the radius of the interconnected gears and input pinions of the launcher rotating system, a desired input-to-output gear ratio can be achieved. For example, the radius of the gears and pinions can be reduced to provide for a faster rotation output to the launcher, due to the fact that a given movement of the gear train produces more revolutions of the gears and input pinions than are produced with a greater radius of the gears and input pinions.

Additionally, one skilled in the art will appreciate that the gear mechanism described herein is for illustrative purposes and the invention is not intended to be limited thereto, as other gear mechanisms can be envisioned for spinning the toy wheel.

For further illustration, FIGS. 3 through 7 depict the toy 100 from various angles. As show in FIGS. 3 through 7, the toy 100 includes a handle 104, launcher 106, key 110, and trigger 116 for operating the toy 100.

What is claimed is:

1. A toy for rotating and launching an object, comprising:

a wheel having a hub with a receiving element connected with the hub of the wheel, the wheel having a peripheral circumference;

a housing;

a launcher extending from the housing, the launcher configured to impart a rotary motion to the wheel, wherein the launcher comprises a driving element configured to engage the receiving element to form a drive connection therebetween, such that when the driving element engages the receiving element, the wheel is rotationally accelerated in one direction;

a launcher rotating system mounted inside the housing and connected with the launcher, the launcher rotating system configured to impart a rotary motion to the launcher; and an energy storing system mounted inside the housing and drivingly connected with the launcher rotating system, the energy storing system being configured to store potential energy and where upon release, the potential energy is converted to kinetic energy to impart a rotary motion to the launcher; and wherein the housing is formed such that when the wheel is attached with the launcher, the peripheral circumference of the wheel is exposed, whereby a user may use the toy to rotate and launch the wheel from the toy.

2. The toy as set forth in claim 1, wherein the launcher rotating system includes a launcher attachment mechanism that is formed to engage with a corresponding object attachment mechanism that is connected with the wheel such that the wheel can be detachably attached with the toy, where upon actuation of the launcher attachment mechanism, the object attachment mechanism is released from the toy.

3. The toy as set forth in claim 2, further comprising a key attached with the housing and operably connected with the energy storing system for winding the energy storing system to store potential energy therein.

4. The toy as set forth in claim 3, further comprising a trigger attached with the housing and operably connected with both the energy storing system and the launcher attachment mechanism, the trigger being operably connected with the energy storing system and the launcher attachment mechanism such that upon actuation of the trigger, the potential energy stored in the energy storing system is converted to kinetic energy to cause the launcher rotating system to rotate the launcher and the launcher attachment mechanism releases the object attachment mechanism, thereby launching the wheel.

5. The toy as set forth in claim 4, wherein the driving element comprises two substantially helical tabs extending outward in a parallel configuration from an output axle about an axis, the axis running substantially parallel to and substantially centered in the output axle, and wherein the receiving element of the wheel is similarly configured with two substantially helical tabs extending outward in parallel configuration about an axis, the axis running perpendicular to the rotational motion of the wheel, and wherein the two substantially helical tabs of each of the driving element and receiving element has an edge that runs parallel to the axis of the respective driving element and receiving element, such that the edge of the driving element rests flush against the edge of the receiving element, forming a drive connection which allows the rotation of the driving element to rotate the receiving element.

6. The launcher of claim 5, wherein the edge of the driving element and the edge of the receiving element are formed as matching and interlocking shapes, such that when the edge of the driving element is matched with the edge of the receiving element, an interlocking drive connection is formed.

7. The launcher of claim 6, wherein the edge of the driving element and the edge of the receiving element are formed as a hook shapes, such that when the edge of the driving element is matched up with the edge of the receiving element, an interlocking drive connection is formed.

8. The toy as set forth in claim 7, wherein the launcher rotating system comprises a series of interconnected gears and axles, the gears and axles capable of rotating the launcher.

9. The toy as set forth in claim 2, further comprising a trigger attached with the housing and operably connected with both the energy storing system and the launcher attachment mechanism, the trigger being operably connected with the energy storing system and the launcher attachment mechanism such that upon actuation of the trigger, the potential energy stored in the energy storing system is converted to kinetic energy to cause the launcher rotating system to rotate the launcher and the launcher attachment mechanism releases the object attachment mechanism, thereby launching the wheel.

10. The toy as set forth in claim 1, wherein the driving element comprises two substantially helical tabs extending in a parallel configuration from the shaft about an axis, the axis running substantially parallel to and substantially centered in the shaft, and wherein the receiving element of the wheel is similarly configured with two substantially helical tabs extending outward in parallel configuration about an axis, the axis running perpendicular to the rotational motion of the wheel, and wherein the two substantially helical tabs of each of the driving element and receiving element has an edge that runs parallel to the axis of the respective driving element and receiving element, such that the edge of the driving element rests flush against the edge of the receiving element, forming a drive connection which allows the rotation of the driving element to rotate the receiving element.

11. The launcher of claim 10, wherein the edge of the driving element and the edge of the receiving element are formed as matching and interlocking shapes, such that when the edge of the driving element is matched with the edge of the receiving element, an interlocking drive connection is formed.

12. The launcher of claim 10, wherein the edge of the driving element and the edge of the receiving element are formed as a hook shapes, such that when the edge of the driving element is matched up with the edge of the receiving element, an interlocking drive connection is formed.

13. The toy as set forth in claim 1, wherein the launcher rotating system comprises a series of interconnected gears and axles, the gears and axles capable of rotating the launcher.

14. The toy as set forth in claim 1, further comprising a key attached with the housing and operably connected with the energy storing system for winding the energy storing system to store potential energy therein.

* * * * *